US010109904B2

(12) United States Patent
Lee et al.

(10) Patent No.: US 10,109,904 B2
(45) Date of Patent: Oct. 23, 2018

(54) COAXIAL TRANSMISSION LINE INCLUDING ELECTRICALLY THIN RESISTIVE LAYER AND ASSOCIATED METHODS

(71) Applicant: Keysight Technologies, Inc., Minneapolis, MN (US)

(72) Inventors: Gregory S. Lee, Mountain View, CA (US); Lewis R. Dove, Monument, CO (US)

(73) Assignee: Keysight Technologies, Inc., Santa Rosa, CA (US)

( * ) Notice: Subject to any disclaimer, the term of this patent is extended or adjusted under 35 U.S.C. 154(b) by 0 days.

(21) Appl. No.: 14/823,997

(22) Filed: Aug. 11, 2015

(65) Prior Publication Data

US 2017/0047632 A1 Feb. 16, 2017

(51) Int. Cl.

| | |
|---|---|
| ***H01P 3/06*** | (2006.01) |
| ***H01P 3/08*** | (2006.01) |
| ***H01P 1/202*** | (2006.01) |
| ***H01P 1/203*** | (2006.01) |

(52) U.S. Cl.

CPC ..... *H01P 3/06* (2013.01); *H01P 1/202* (2013.01); *H01P 1/20309* (2013.01); *H01P 3/081* (2013.01); *H01P 3/082* (2013.01); *H01P 3/085* (2013.01)

(58) Field of Classification Search

CPC .. H01P 3/06; H01P 3/081; H01P 3/082; H01P 3/085; H01P 3/18; H01P 1/202

USPC ..... 333/243

See application file for complete search history.

(56) References Cited

U.S. PATENT DOCUMENTS

| | | | | |
|---|---|---|---|---|
| 3,460,072 A * | 8/1969 | Ziegler, Jr. | H01P 5/026 333/33 |
| 3,544,928 A * | 12/1970 | Keiter | H01B 11/1834 333/245 |
| 4,004,257 A | 1/1977 | Geissler | |
| 4,853,656 A | 8/1989 | Guillou et al. | |
| 5,029,243 A | 7/1991 | Dammann et al. | |
| 5,065,123 A | 11/1991 | Heckaman et al. | |

(Continued)

FOREIGN PATENT DOCUMENTS

| | | |
|---|---|---|
| CN | 201243152 Y | 5/2009 |
| EP | 675507 B1 | 6/2000 |

OTHER PUBLICATIONS

Maistrenko et al., "Experimental investigation of shielded microstriplines with resistive films in substrate", 15th Int. Crimean Conference "Microwave & Telecommunication Technology", Sep. 12-16, 2005, Sevastopol, Crimea, Ukraine, p. 554-555.

(Continued)

*Primary Examiner* — Stephen E. Jones
*Assistant Examiner* — Samuel S Outten

(57) ABSTRACT

A coaxial transmission line, e.g. a coaxial cable, includes an inner electrical conductor, an outer electrical conductor, a dielectric region between the inner electrical conductor and the outer electrical conductor, and an electrically thin resistive layer within the dielectric region and concentric with the inner electrical conductor and the outer electrical conductor. The electrically thin resistive layer is a resistive layer configured to be transparent to a subtantially transverse-electromagnetic (TEM) mode of transmission, while absorbing higher order modes of transmission.

24 Claims, 8 Drawing Sheets

(56) References Cited

U.S. PATENT DOCUMENTS

| | | | | |
|---|---|---|---|---|
| 5,468,913 | A | 11/1995 | Seaman et al. | |
| 5,817,981 | A | 10/1998 | Arroyo | |
| 5,894,197 | A * | 4/1999 | Langlois | H01J 19/32 315/39 |
| 6,023,209 | A | 2/2000 | Faulkner et al. | |
| 6,259,496 | B1 | 7/2001 | Kashima | |
| 6,417,454 | B1 | 7/2002 | Biebuyck | |
| 6,447,333 | B1 | 9/2002 | Springer | |
| 7,811,125 | B2 | 10/2010 | Kretz et al. | |
| 7,986,020 | B2 | 7/2011 | Kagaya | |
| 8,063,713 | B2 | 11/2011 | Cheng et al. | |
| 8,212,580 | B2 | 7/2012 | Izadian | |
| 8,508,311 | B2 | 8/2013 | Wu et al. | |
| 8,657,066 | B2 | 2/2014 | Doneker et al. | |
| 8,658,897 | B2 | 2/2014 | Doneker et al. | |
| 9,362,601 | B2 | 6/2016 | McKinzie, III | |
| 9,574,661 | B2 | 2/2017 | Somoza et al. | |
| 2002/0180923 | A1 | 12/2002 | Aoyagi et al. | |
| 2003/0151476 | A1 | 8/2003 | Salmela et al. | |
| 2005/0067159 | A1 | 3/2005 | Hall et al. | |
| 2005/0259195 | A1 | 11/2005 | Koganezawa | |
| 2007/0014946 | A1 | 1/2007 | Huang et al. | |
| 2009/0111315 | A1 | 4/2009 | Kato et al. | |
| 2010/0085132 | A1 | 4/2010 | Cheng et al. | |
| 2010/0171042 | A1 | 7/2010 | Kellerman et al. | |
| 2010/0277256 | A1 | 11/2010 | Concord | |
| 2012/0025925 | A1 | 2/2012 | Wu et al. | |
| 2012/0112784 | A1 | 5/2012 | Masuda et al. | |
| 2012/0194291 | A1 | 8/2012 | Pajovic | |
| 2012/0239209 | A1 | 9/2012 | Brown et al. | |
| 2012/0299669 | A1 | 11/2012 | Ryu et al. | |
| 2013/0112477 | A1 | 5/2013 | Lorenz et al. | |
| 2014/0170919 | A1 | 6/2014 | Manipatruni et al. | |
| 2014/0227905 | A1 | 8/2014 | Knott et al. | |
| 2015/0004833 | A1 | 1/2015 | Ryu et al. | |
| 2017/0025149 | A1 | 1/2017 | Ahner et al. | |

OTHER PUBLICATIONS

Maistrenko et al., "Calculation of shielded microstrip line with various configuration of resistance films in substrate", 4th Int. Crimean Conference "Microwave & Telecommunication Technology", Sep. 13-17, 2004, Sevastopol, Crimea, Ukraine, p. 449-450.
Deng, et al., "An Experimental Investigation of Higher Order Mode Suppression in TEM Cells", IEEE Transactions on Electromagnetic Compatibility, vol. 50, No. 2, May 2008, p. 416-419.
International Search Report & Written Opinion dated Oct. 19, 2016 for International Application No. PCT/US2016/039593, 12 pages.
Howard, et al., "Improving VSWR and Bandwidth by Eliminating Steps in Coaxial Connectors", International Conference on Computing, Engineering, and Information, Fullerton, California, USA, Apr. 2-4, 2009, p. 237-239.
Oldfield, et al., "The Importance of Coax Connector Design Above 110 GHz", Anritsu Technical Review No. 22, Sep. 2014, p. 40-44.
English language machine translation of CN201243152Y, published May 20, 2009, 7 pages.
Non-Final Office Action dated Aug. 11, 2017 for co-pending U.S. Appl. No. 15/008,368, 32 pages.
"Differential signaling", From Wikipedia, the free encycolpedia [online] [retrieved on Nov. 2, 2017]. Retrieved from the Internet <URL: https://en.wikipedia.org/wiki/Differential_Signaling>, 5 pages.
"Single Ended vs Differential Inputs", Omega Engineering [online] [retrieved on Nov. 2, 2017]. Retrieved from the Internet <URL: https://www.omega.com/techref/das/se-differential.html>, 2 pages.
Martin, Ferran, "Artificial Transmission Lines for RF and Microwave Applications", First Edition, 2015, John Wiley & Sons, Inc., Hoboken, New Jersey, p. 410-414.
Notice of Allowance dated Nov. 3, 2017 in co-pending U.S. Appl. No. 15/223,901, 9 pages.
Office Action dated Nov. 2, 2017 in co-pending U.S. Appl. No. 15/594,996, 16 pages.
Supplemental Notice of Allowability dated Nov. 20, 2017 in co-pending U.S. Appl. No. 15/223,901, 5 pages.
Office Action dated Jan. 25, 2018 in co-pending U.S. Appl. No. 15/008,368, 37 pages.
Chakraborty, et al., "Exploiting the Loss-Frequency Relationship using RF Communication in Underwater Communication Networks", 2009 International Conference on Computers and Devices for Communication, Dec. 14-16, 2009, 4 pages.
Garg, et al., "A Thin Wall Leaky Waveguide Antenna", IEEE Transactions on Antennas and Propagation, Jan. 1975, p. 107-112.
Final Office Action dated Mar. 16, 2018 in co-pending U.S. Appl. No. 15/594,996, 29 pages.
Examiner's Interview Summary dated Dec. 22, 2017 in co-pending U.S. Appl. No. 15/008,368, 3 pages.
Co-pending U.S. Appl. No. 15/223,901 filed Jul. 29, 2016.
Notice of Allowance dated Jun. 30, 2017 in co-pending U.S. Appl. No. 15/223,901, 8 pages.
International Patent Application No. PCT/US17/55712 filed Oct. 9, 2017.

* cited by examiner $k_c a$ FOR $TM_{mn}$ MODES (n=RADIAL INDEX, m=AZIMUTHAL INDEX)

| n / m | 0 | 1 | 2 | 3 | 4 | 5 |
|---|---|---|---|---|---|---|
| 1 | 4.53 | 4.806* | 5.536 | 6.528 | 7.638 | 8.787 |
| 2 | 9.161 | 9.32 | 9.784 | 10.51 | 11.44 | 12.509 |

FIG.6

$k_c a$ FOR $TE_{mn}$ MODES (n=RADIAL INDEX, m=AZIMUTHAL INDEX)

| n / m | 0 | 1 | 2 | 3 | 4 | 5 |
|---|---|---|---|---|---|---|
| 1 | 4.806* | 1.561 | 2.951 | 4.173 | 5.311 | 6.415 |
| 2 | 9.32 | 5.203 | 6.267 | 7.671 | 9.108 | 10.452 |

FIG.7

COAXIAL TRANSMISSION LINE INCLUDING ELECTRICALLY THIN RESISTIVE LAYER AND ASSOCIATED METHODS

BACKGROUND

Signal transmission lines ('transmission lines') are ubiquitous in modern communications. These transmission lines transmit electromagnetic (EM) signals ('signals') from point to point, and take on various known forms including stripline, microstripline ('microstrip'), and coaxial ("coax") transmission lines, to name a few.

It is desirable for these transmission lines to support a single eigenmode ('single mode') of signal propagation. Multi-mode signal propagation is problematic because the desired propagation mode and higher-order modes may interfere with each other to provide a received signal that is severely frequency-dependent in an uncontrolled and usually un-interpretable manner. This is analogous to the well-known multipath problem in wireless propagation, except in this instance the problem occurs in a "wired" setting. In high-bandwidth, high-quality signal environments multi-mode signal propagation is typically unacceptable.

What is needed, therefore, is a transmission line that fosters discrimination of a desired TEM mode of signal propagation from the higher-order modes.

BRIEF DESCRIPTION OF THE DRAWINGS

The example embodiments are best understood from the following detailed description when read with the accompanying drawing figures. It is emphasized that the various features are not necessarily drawn to scale. In fact, the dimensions may be arbitrarily increased or decreased for clarity of discussion. Wherever applicable and practical, like reference numerals refer to like elements.

FIGS. 6 and 7 are tables illustrating mode cutoff eigenvalues of higher order modes, for a 50-ohm coaxial cable, that may/may not be attenuated in the representative embodiments.

DETAILED DESCRIPTION

Figure 1:
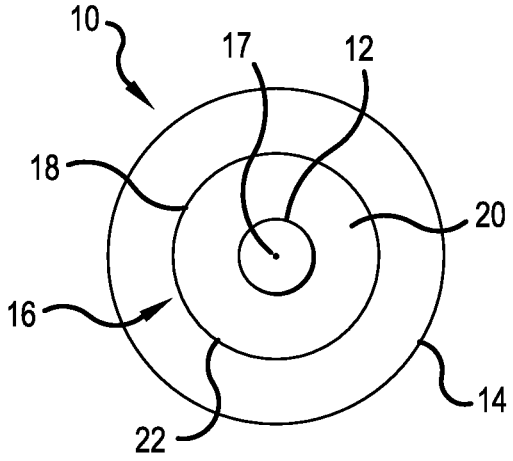
FIG. 1 is a cross-sectional view of a coaxial transmission line in accordance with a representative embodiment.

In the following detailed description, for purposes of explanation and not limitation, example embodiments disclosing specific details are set forth in order to provide a thorough understanding of an embodiment according to the present teachings. However, it will be apparent to one having ordinary skill in the art having the benefit of the present disclosure that other embodiments according to the present teachings that depart from the specific details disclosed herein remain within the scope of the appended claims. Moreover, descriptions of well-known apparatuses and methods may be omitted so as to not obscure the description of the example embodiments. Such methods and apparatuses are clearly within the scope of the present teachings.

The terminology used herein is for purposes of describing particular embodiments only, and is not intended to be limiting. The defined terms are in addition to the technical and scientific meanings of the defined terms as commonly understood and accepted in the technical field of the present teachings.

Unless otherwise noted, when a first element (e.g., a signal transmission line) is said to be connected to a second element (e.g., another signal transmission line), this encompasses cases where one or more intermediate elements (e.g., an electrical connector) may be employed to connect the two elements to each other. However, when a first element is said to be directly connected to a second element, this encompasses only cases where the two elements are connected to each other without any intermediate or intervening devices. Similarly, when a signal is said to be coupled to an element, this encompasses cases where one or more intermediate elements may be employed to couple the signal to the element. However, when a signal is said to be directly coupled to an element, this encompasses only cases where the signal is directly coupled to the element without any intermediate or intervening devices.

As used in the specification and appended claims, the terms 'a', 'an' and 'the' include both singular and plural referents, unless the context clearly dictates otherwise. Thus, for example, 'a device' includes one device and plural devices. As used in the specification and appended claims, and in addition to their ordinary meanings, the terms 'substantial' or 'substantially' mean to within acceptable limits or degree. As used in the specification and the appended claims and in addition to its ordinary meaning, the term 'approximately' means to within an acceptable limit or amount to one having ordinary skill in the art. For example, 'approximately the same' means that one of ordinary skill in the art would consider the items being compared to be the same.

Relative terms, such as "above," "below," "top," "bottom," may be used to describe the various elements' relationships to one another, as illustrated in the accompanying drawings. These relative terms are intended to encompass different orientations of the elements thereof in addition to the orientation depicted in the drawings. For example, if an apparatus (e.g., a semiconductor package) depicted in a drawing were inverted with respect to the view in the drawings, an element described as "above" another element, for example, would now be "below" that element. Similarly, if the apparatus were rotated by 90° with respect to the view in the drawings, an element described "above" or "below" another element would now be "adjacent" to the other element; where "adjacent" means either abutting the other element, or having one or more layers, materials, structures, etc., between the elements.

In accordance with a representative embodiment, a signal transmission line comprises: a first electrical conductor; a second electrical conductor; a dielectric region between the first electrical conductor and the second electrical conductor; and an electrically thin resistive layer disposed within the dielectric region and disposed between the first electrical conductor and the second electrical conductor. The electrically thin resistive layer is configured to be substantially transparent to a substantially transverse-electromagnetic (TEM) mode of transmission, yet substantially completely attenuating higher order modes of transmission.

Figure 9:
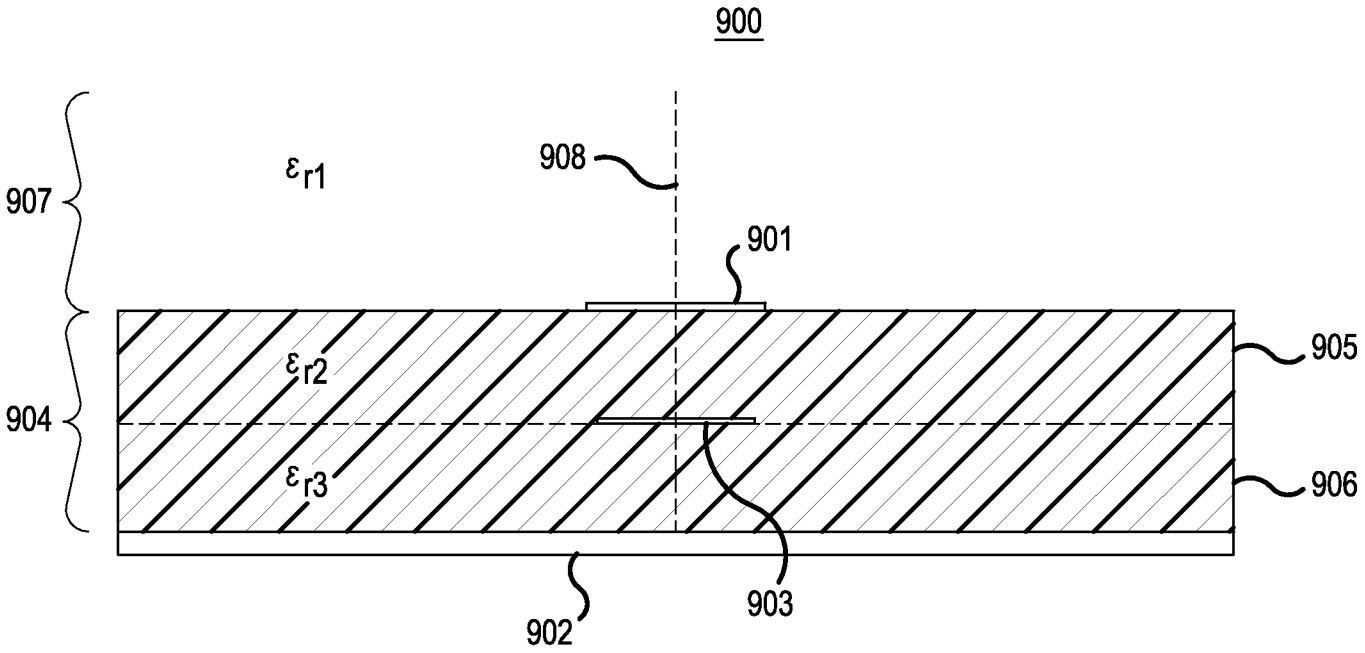
FIG. 9 is a cross-sectional view of a microstripline (microstrip) transmission line in accordance with a representative embodiment.

As will become clearer as the present description continues, the lowest order (and desired mode) of the transmission lines of the representative embodiments is a "substantially" TEM mode. To this end, a TEM mode is somewhat of an idealization that follows from the solutions to Maxwell's Equations. In reality, at any nonzero frequency, the "TEM mode" actually has small deviations from a purely transverse electric field due to the imperfect nature of the conductors of the transmission line. Also, inhomogeneity in the dielectric region(s) (e.g., comprising first and second dielectric layers 905, 906 as depicted in FIG. 9) will lead to dispersion and deviation from the behavior of an 'ideal' TEM mode, (which is technically dispersionless) in coaxial transmission lines, stripline, etc. at higher frequencies. As such, the term "substantially TEM" mode accounts for such deviations from the ideal behavior due to the environment of the transmission lines of the representative embodiments described below.

The present teachings are described initially in connection with representative embodiments that comprise a coaxial transmission line (or, variously coaxial cable). As will be appreciated as the present description continues, the comparatively symmetrical structure of the coaxial transmission line enables the description of various salient features of the present teachings in a comparatively straight-forward manner. However, it is emphasized that the present teachings are not limited to representative embodiments comprising coaxial transmission lines. Rather, and as described more fully below, the present teachings are contemplated for use in other types of transmission lines to include transmission lines with an inner conductor that is geometrically offset relative to an outer conductor, stripline transmission lines, and microstrip transmission lines, which are transmitting substantially TEM modes. Moreover, the present teachings are contemplated for devices used to effect connections between a transmission line and an electrical device, or other transmission line (e.g., electrical connectors, adapters, attenuators, etc.). By way of example, the ends of coaxial transmission line may terminate at a coaxial electrical connector (not show) that is designed to maintain a coaxial form across the connection and have substantially the same impedance as the coaxial transmission line to reduce reflections back into the coaxial transmission line. Connectors are usually plated with high-conductivity metals such as silver or tarnish-resistant gold.

Figure 2:
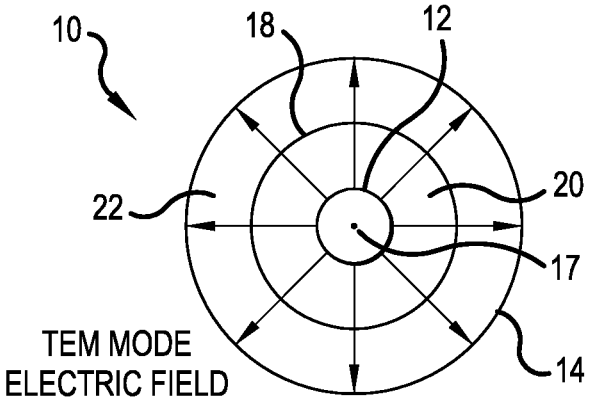
FIG. 2 is a cross-sectional view of the representative embodiment of FIG. 1 and illustrating the TEM mode electric field.
Figure 3:
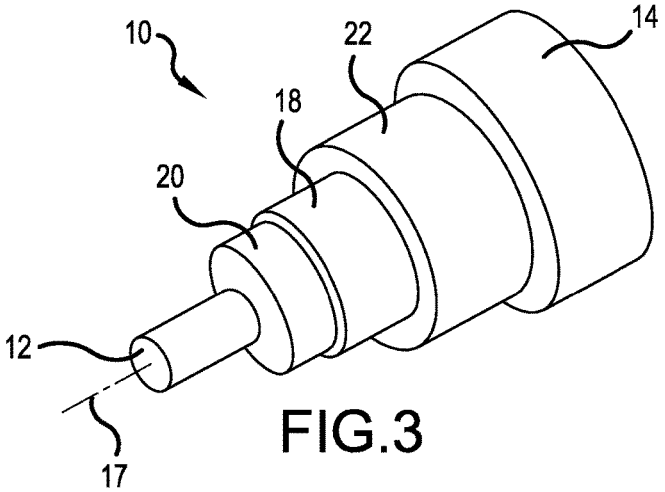
FIG. 3 is a perspective view of the representative embodiment of FIG. 1.

Referring now to FIGS. 1-3, a coaxial transmission line 10 in accordance with a representative embodiment will now be described. The coaxial transmission line 10 is shown in the drawings as a coaxial cable, for example. The coaxial transmission line 10 includes an inner electrical conductor 12 (sometimes referred to as a first electrical conductor), an outer electrical conductor 14 (sometimes referred to as a second electrical conductor), a dielectric region 16 between the inner electrical conductor 12 and the outer electrical conductor 14, and an electrically thin resistive layer 18 within the dielectric region 16 and concentric with the inner electrical conductor 12 and the outer electrical conductor 14.

In representative embodiments, the electrically thin resistive layer 18 is continuous and extends along the length of the coaxial transmission line 10. The continuity of the electrically thin resistive layer is common to the transmission lines of other representative embodiments described herein. Alternatively, the electrically thin resistive layer 18, as well the electrically thin resistive layer of other representative embodiments may be discontinuous, and thereby having gaps along the length of the particular transmission line.

The inner electrical conductor 12 has a common propagation axis 17 with, the outer electrical conductor 14. Similarly, the inner conductor and the outer electrical conductor 14 share a common geometric center (e.g., a point on the common propagation axis 17). Moreover, the coaxial transmission line 10 is substantially circular in cross-section. Generally, the term 'coaxial' means the various layers/regions of a transmission line have a common propagation axis. Likewise the term 'concentric' means layers/regions of a transmission line have the same geometric center. As will be appreciated as the present description continues, the transmission lines of some representative embodiments are coaxial and concentric, whereas in other representative embodiments the transmission lines are not concentric. Finally, the transmission lines of the representative embodiments are not limited to those circular in cross-section. Rather, transmission lines with other cross-sections are contemplated, including but not limited to, rectangular and elliptical cross-sections.

As may be appreciated by those skilled in the art, the inner electrical conductor 12 and the outer electrical conductor 14 may be any suitable electrical conductor such as a copper wire, or other metal, metal alloy, or non-metal electrical conductor. The dielectric materials or layers contemplated for use in dielectric region 16 include, but are not limited to glass fiber material, plastics such as polytetrafluoroethylene (PTFE), low-k dielectric material with a reduced loss tangent (e.g., $10^{-2}$), ceramic materials, liquid crystal polymer (LCP), or any other suitable dielectric material, including air, and combinations thereof. A protective sheath can include a protective plastic coating or other suitable protective material, and is preferably a non-conductive insulating sleeve. In representative embodiments described below, the dielectric region 16 may comprise one or more dielectric layers. Notably, the number of dielectric layers described in the various representative embodiments is generally illustrative, and more (than one) or fewer layers are contemplated. However, generally the dielectric constants of the various dielectric layers are substantially the same in order to support substantially TEM modes of propagation.

The coaxial transmission line 10 differs from other shielded cable used for carrying lower-frequency signals, such as audio signals, in that the dimensions of the coaxial transmission line 10 are controlled to give a substantially precise, substantially constant spacing between the inner electrical conductor 12 and the outer electrical conductor 14.

Coaxial transmission line 10 is often used as a transmission line for radio frequency signals. Applications of coaxial transmission line 10 include feedlines connecting radio transmitters and receivers with their antennas, computer network (Internet) connections, and distributing cable television signals. In radio-frequency applications, the electric and magnetic signals propagate primarily in the substantially transverse electric magnetic (TEM) mode, which is the single desired mode to be supported by the transmission line. In a substantially TEM mode, the electric and magnetic fields are both substantially perpendicular to the direction of propagation. However, above a certain cutoff frequency, transverse electric (TE) or transverse magnetic (TM) modes, or both, can also propagate, as they do in a waveguide. It is usually undesirable to transmit signals above the cutoff frequency, since it may cause multiple modes with different phase velocities to propagate, interfering with each other. The average of the circumference between the inner electrical conductor 12 and the inside of the outer electrical conductor 14 is roughly inversely proportional to the cutoff frequency.

As illustrated in FIGS. 2 and 3, the electrically thin resistive layer 18 is an electrically resistive layer selected and configured, as described below, to be substantially transparent to a substantially transverse-electromagnetic (TEM) mode of transmission, while substantially completely attenuating higher order modes of transmission. Generally, substantially completely attenuating means the coaxial transmission line 10, or other transmission line according to representative embodiments described herein, is designed to accommodate a predetermined threshold of relative attenuation between the desired substantially TEM mode and the undesired higher order modes. As will be appreciated, among other design consideration, this predetermined threshold is realized through the selection of the appropriate thickness (e.g., via the skin depth described below) and resistivity of the electrically thin resistive layer 18. For example, in an application where RF frequencies up to $10^2$ GHz are relevant and the transmission length is on the order of $10^1$ cm, the threshold of relative attenuation requires a TEM attenuation constant of approximately 0.1 $m^{-1}$, but attenuation of the higher order modes by more than approximately 100 $m^{-1}$, and usefully over approximately 1000 $m^{-1}$ are contemplated. On the other hand, in an application where the highest frequency of operation is only a few GHz (or less) and the transmission length is tens of meters, the threshold of relative attenuation requires a TEM attenuation constant of approximately 0 $m^{-1}$, to approximately 0.01 $m^{-1}$, while attenuating the higher order modes by at least approximately 1.0 $m^{-1}$, but usefully by more than approximately 10 $m^{-1}$ are contemplated. It is emphasized that these examples are merely illustrative, and are not intended to be limiting of the present teachings.

As used herein, an "electrically thin" layer is one for which the layer thickness is less than the skin depth δ at the (highest) signal frequency of interest. This insures that the substantially TEM mode is minimally absorbed. The skin depth is given by $\delta=1/\sqrt{(\pi f\mu\sigma)}$, where δ is in meters, f is the frequency in Hz, μ is the magnetic permeability of the layer in Henrys/meter, and σ is the conductivity of the layer in Siemens/meter.

So for the discussion herein, if t is the physical thickness of the electrically thin resistive layer 18, it is "electrically thin" if $t<\delta_{min}=1/\sqrt{(\pi f_{max}\mu\sigma)}$, where $\delta_{min}$ is the skin depth calculated at the maximum frequency $f_{max}$. For example, suppose $f_{max}$=200 GHz, the layer is nonmagnetic and hence $\mu=\mu_0$=the vacuum permeability=4π*10-7 Henrys/meter, and the conductivity is 100 Siemens/meter. Then $\delta_{min}$=112.5 μm, so a resistive layer thickness t of 25 μm would be considered electrically thin in this case. Recapitulating, the electrically thin resistive layer 18 is electrically thin when its thickness is less than a skin depth at a maximum operating frequency of the coaxial transmission line 10.

The dielectric region 16 may comprise an inner dielectric material 20 between the inner electrical conductor 12 and the electrically thin resistive layer 18, and an outer dielectric material 22 between the electrically thin resistive layer 18 and the outer electrical conductor 14. In various embodiments, the inner dielectric material 20 and the outer dielectric material 22 have approximately the same thickness. In some embodiments, a thickness of the inner dielectric material 20 is approximately twice a thickness of the outer dielectric material 22.

The electrically thin resistive layer 18 may be an electrically thin resistive coating on the inner dielectric material 20. The electrically thin resistive layer 18 illustratively includes at least one of TaN, WSiN, resistively-loaded polyimide, graphite, graphene, transition metal dichalcogenide (TMDC), nichrome (NiCr), nickel phosphorus (NiP), indium oxide, and tin oxide. Notably, however, other materials within the purview of one of ordinary skill in the art having the benefit of the present teachings, are contemplated for use as the electrically thin resistive layer 18.

Transition metal dichalcogenides (TMDCs) include: $HfSe_2$, $HfS_2$, $SnS_2$, $ZrS_2$, $MoS_2$, $MoSe_2$, $MoTe_2$, $WS_2$, $WSe_2$, $WTe_2$, $ReS_2$, $ReSe_2$, $SnSe_2$, $SnTe_2$, $TaS_2$, $TaSe_2$, MoSSe, WSSe, $MoWS_2$, $MoWSe_2$, $PbSnS_2$. The chalcogen family includes the Group VI elements S, Se and Te.

The electrically thin resistive layer 18 may have an electrical sheet resistance between 20-2500 ohms/sq and preferably between 20-200 ohms/sq.

Figure 4:
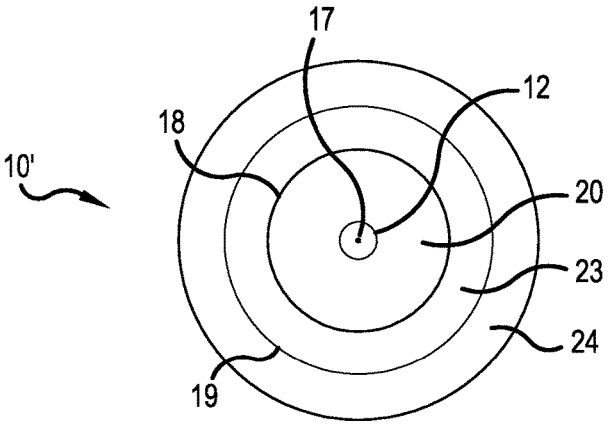
FIG. 4 is a cross-sectional view of a coaxial transmission line in accordance with a representative embodiment.

With additional reference to FIG. 4, another embodiment of a coaxial transmission line 10' will be described. In this embodiment, an additional electrically thin resistive layer 19 is included within the dielectric region and concentric with the inner electrical conductor 12 and the outer electrical conductor 14. In such an embodiment, the dielectric region includes the inner dielectric material 20, a middle dielectric material 23, and an outer dielectric material 24. Such dielectric materials may include the same or different materials. Multiple electrically thin resistive layers may be included based upon desired attenuation characteristics.

Adding a second electrically thin resistive layer, perhaps ⅔ of the way in from the outer electrical conductor 14 may be better positioned to attenuate some higher order modes, and may be beneficial in the presence of multiple discontinuities or with a poorly matched load. It may also be useful to allow a cable to be bent multiple times. So, it may be desired to include the additional electrically thin resistive layer 19 between electrically thin resistive layer 18 and the outer electrical conductor 14. However, the benefits of the additional electrically thin resistive layer 19 must be weighed against the possible disadvantage that the additional electrically thin resistive layer 19 may add some insertion loss for the dominant substantially TEM mode.

Figure 5:
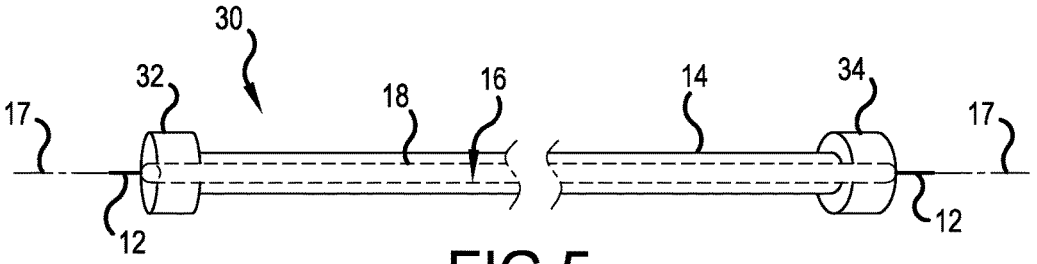
FIG. 5 is a side view of a coaxial transmission line in accordance with a representative embodiment.

With additional reference to FIG. 5, another embodiment is described. Here, the inner electrical conductor 12, outer electrical conductor 14 and dielectric region 16 define a length of coaxial cable 30, with coaxial connectors 32, 34 at opposite ends of the coaxial cable 30. The electrically thin resistive layer 18 extends within the entire length of coaxial cable 30 and within the coaxial connectors 32, 34.

Also, in other embodiments, the inner electrical conductor 12, outer electrical conductor 14 and dielectric region 16 may define a length of micro-coaxial transmission line.

Having set forth the various structures of the exemplary embodiments above, features, advantages and analysis will now be discussed. The example embodiments are directed to a coaxial transmission line 10, 10', e.g. a coaxial cable 30, in which a concentric electrically thin resistive layer 18 is sandwiched somewhere within the insulating (dielectric) region 16 that separates the inner electrical conductor 12 and outer electrical conductor 14. Namely, in addition to the typical inner and outer electrical conductors 12/14 made out of metals with high conductivity, we now have an inner dielectric and an outer dielectric separated by an electrically thin cylindrical resistive layer 18. All regions, inner electrical conductor 12, inner dielectric material 20, electrically thin cylindrical resistive layer 18, outer dielectric material 22, and outer electrical conductor 14 are concentric. The term coaxial and/or concentric means that the layers/regions have the same axis/center. This is not limited to any particular cross-section. Circular, rectangular and other cross sections are contemplated herein. By way of example, the inner and outer conductors may have other cross-sectional shapes, such as rectangular (described below). Alternatively, the inner and outer conductors may have different cross-sectional shapes (e.g., the inner conductor may be circular in cross-section, and the outer conductor may be rectangular in cross-section). Regardless of the shapes of the inner and outer conductors, the electrically thin resistive layer is selected to have a shape so that the electric field lines of the substantially TEM mode are substantially perpendicular (i.e., substantially parallel to the normal of the electrically thin resistive layer) at each point of incidence, and to be substantially transparent to the substantially TEM mode of transmission, while substantially attenuating higher order modes of transmission.

As in conventional coax, the desired substantially transverse electromagnetic (TEM) features an everywhere substantially radially directed electric field, as shown in FIG. 2. All higher order modes, whether transverse electric (TE) or transverse magnetic (TM), fail to have this property.

In particular, all TM modes have a strong longitudinal (along the axis) component of electric field. These longitudinal electric vectors will generate axial RF currents in the resistive cylinder, leading to high ohmic dissipation of the TM modes. Conversely, the TE modes have pronounced azimuthal (i.e., clockwise or counterclockwise directed about the axis) electric field vectors, which in turn generate local azimuthal currents in the resistive cylinder. Again, since a resistive sheet is not a good electrical conductor, this results in high ohmic dissipation of the TE modes.

The substantially TEM mode, on the other hand, suffers little ohmic dissipation because the thin resistive cylinder does not allow radial currents to flow.

An important advantage of the embodiments of the present teachings is the realization of comparatively larger dimensions for both the inner and outer electrical conductors to be used at higher frequencies. This results in less electrically conductive loss for the desired broadband substantially TEM mode due to reduced current crowding. It also allows the potential use of sturdier connectors and a sturdier cable itself to a given maximum TEM frequency. As opposed to waveguide technology, the present embodiments are still a truly broadband (DC to a very high frequency, e.g. millimeter waves or sub-millimeter waves) conduit.

In practice, the industry likes to deal with 50-ohm cables at millimeter-wave frequencies. The usual dielectric PTFE has a relative dielectric constant of approximately 1.9—the exact value depends on the type of PTFE and the frequency, but this is close enough for this discussion. For this dielectric value in conventional coaxial cable, the ratio of outer electrical conductor ID to inner electrical conductor OD=3.154 to achieve 50Ω characteristic impedance.

An example of a practical frequency extension goal is now discussed. 1.85-mm cable is single-mode up to approximately ~73 GHz. It would be very useful to extend this frequency almost threefold to 220 GHz, for example. A relevant computation is to identify how many and which TE and TM modes between 73 GHz and 220 GHz have to be attenuated by the resistive cylindrical sheet.

A simple way to do this accounting is to compute the dimensionless eigenvalues $k_c a$ for the higher-order modes, where $k_c$ is the cutoff wavenumber=$2\pi/\lambda_c$ and 2a is the outer electrical conductor ID. Here $\lambda_c$ is the free-space cutoff wavelength=$c/f_c$, where $f_c$ is the cutoff frequency and c is the speed of light in vacuum. The lowest eigenvalue corresponds to the ~73 GHz cutoff of the first higher-order mode, which happens to be the TE11 mode. Any eigenvalue within a factor of 3 of the lowest eigenvalue indicates a mode that should be attenuated. Eigenvalues more than a factor of 3 greater than the lowest eigenvalue correspond to modes that are still in cutoff, even at 220 GHz.

The reason for using dimensionless eigenvalues is that the same reasoning can be scaled to other cases. For example, it may be desired to extend the operating frequency of 1-mm cable, which is single-mode to ~120 GHz, to ~360 GHz. The lowest eigenvalue then corresponds to the ~120 GHz cutoff of the $TE_{11}$ mode in 1-mm cable.

The tables in FIGS. 6 and 7 show the accounting for the TE and TM modes, respectively. In FIG. 6, which shows the eigenvalues of TE modes for a 50-ohm Teflon-filled coax, the eigenvalues at $TE_{11}$, $TE_{12}$, and $TE_{13}$ correspond to modes that should be attenuated. The other eigenvalues are modes still in cutoff except for $TE_{10}$ which comes close to the arbitrary "thrice 1st cutoff frequency" rule in this example. In other words, $TE_{10}$ is barely still cutoff at 220 GHz, so resistive attenuation here may be desirable if the maximum operating frequency needs to be pushed just a bit higher.

The table of FIG. 7 shows the eigenvalues of TM modes for a 50-ohm Teflon-filled coax, and it can be seen that there are only a handful of modes to be concerned with resistively attenuating. Beneficially, the sheet resistance and radius of the resistive cylinder can be selected to minimally attenuate the substantially TEM mode while maximally attenuating higher order modes (e.g., the $TE_{11}$ mode).

Let r be the radius of the resistive cylinder. To keep the discussion generic (as opposed to dealing only with 1.85-mm cable), the designer can hone the sheet resistance and the dimensionless ratio a/r, where 2a is the inner diameter ID of the outer electrical conductor 14. Sheet resistance in the range of approximately 20 Ω/sq to approximately 200 Ω/sq and a/r values in the range approximately 1.2 to approximately 2.4 are effective. The resistive cylinder may be substantially midway between the inner electrical conductor 12 and the outer electrical conductor 14.

An example of a way to construct the geometry is to roll a thin resistive sheet around the inner dielectric material 20, already with the inner electrical conductor 12 inside its core. Then the outer dielectric material 22 can be slipped over this partial assembly. Finally the outer electrical conductor 14 can be slipped over on the outside.

Graphite/graphene, MoS2, WS2, and MoSe2 are available in lubricant form, which may lead to an alternative construction method. The inner dielectric material 20 (e.g. a cylinder) can be lubricated with the desired resistive lubricant. The lubrication coating thickness is chosen to produce the desired sheet resistance, depending on the electrical resistivity of the lubricant. The outer dielectric material 22, e.g. initially including two half-cylinders, is then clamshelled about the lubricated inner dielectric material 20. Finally the outer electrical conductor 14 is slipped over the outer dielectric material 22. With a snug fit, the outer electrical conductor 14, e.g. a cylinder, will hold the half shells in place so no adhesive may even be necessary.

A variation of the embodiments of the present teachings is to provide the electrically thin resistive layer 18 only in the "perturbed" lengths of the coaxial cable. That is, in the truly straight sections of a coaxial reach, all the modes are orthogonal so they don't couple to each other. It is only where the ideal coax is perturbed, e.g., at connectors and in bends, that the modes are deformed from their textbook distributions and cross-coupling can occur. Therefore, another strategy is to include the electrically thin resistive layer 18 only in/near the connectors and in pre-bent regions and to advise the cable user to avoid bending prescribed straight sections that may omit the electrically thin resistive layer 18. This approach has the advantage of reducing or minimizing attenuation of the substantially TEM mode which may be especially important for long cables or at very high frequencies where the skin depth of the substantially TEM mode approaches the thickness of the resistive sheet.

Figure 8:
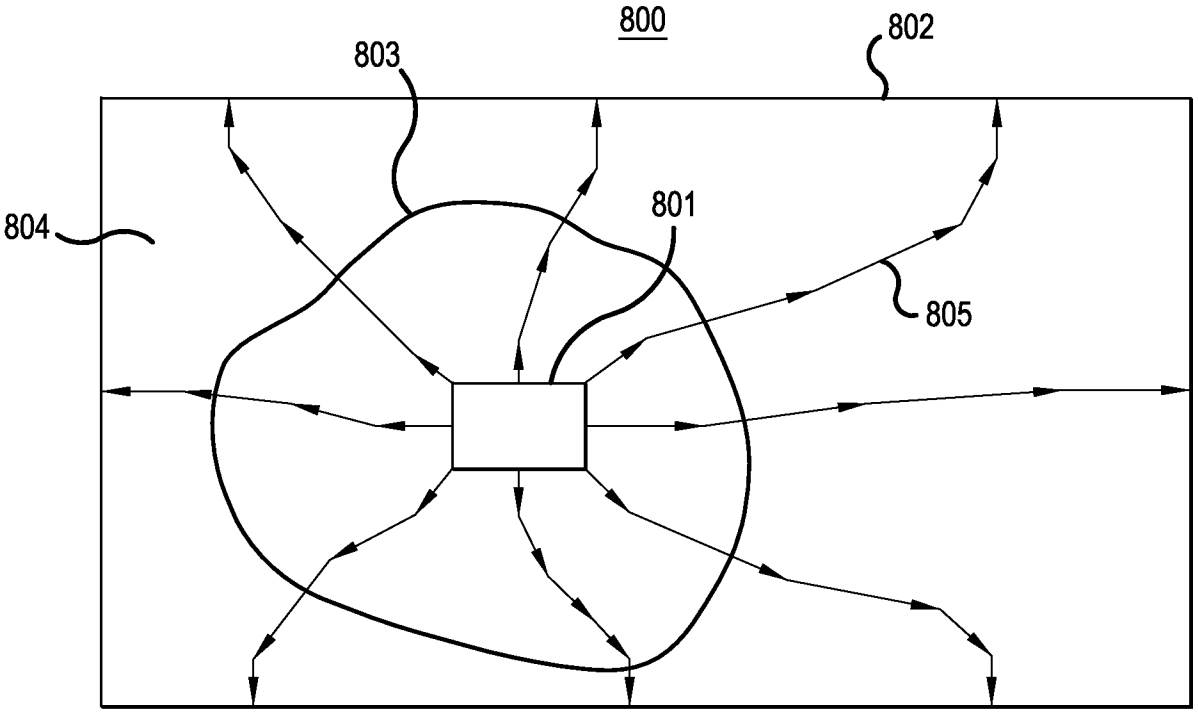
FIG. 8 is a cross-sectional view of a transmission line in accordance with a representative embodiment.

FIG. 8 is a cross-sectional view of a transmission line 800 in accordance with a representative embodiment. Many aspects and details of the transmission line 800 are common to the transmission lines described in connection with the representative embodiments of FIGS. 1-7, above, and may not be repeated in order to avoid obscuring the presently described representative embodiments.

The transmission line 800 comprises a first electrical conductor 801, which functions as a signal line, and a second electrical conductor 802 disposed thereabout, which functions as a ground plane. An electrically thin resistive layer 803 is disposed in a dielectric region 804 and between the first electrical conductor 801 and the second electrical conductor 802. Notably, the dielectric region 804 comprises one or more of the dielectric materials described above. If more than one material is used in the dielectric region 804, their dielectric constants are approximately the same.

The transmission line 800 shows certain features alluded to above, and contemplated by the present teachings. Notably, some of these features may be foregone, with the resulting structure contemplated by the present teachings. The second electrical conductor 802, which is an outer electrical conductor, is neither circular nor elliptical in cross-section. Rather, the second electrical conductor 802 is substantially rectangular. Alternatively, the second electrical conductor 802 could have other cross-sectional shapes, such as square, or polygonal. As can be appreciated, the cross-sectional shape of the second electrical conductor 802, among other things, dictates the supported single mode, in this case a substantially TEM mode, and thus the orientation of the electric field lines. The electrically thin resistive layer 803 has a shape that is selected so that electric field lines 805 of the substantially TEM mode are incident thereon orthogonally (or parallel to the normal to the surface of the electrically thin resistive layer). As in representative embodiments described above in connection with FIGS. 1-7, the electrically thin resistive layer 803 is configured to be substantially transparent to a substantially transverse-electromagnetic (TEM) mode of transmission, while substantially completely attenuating higher order modes of transmission.

The first electrical conductor 801 is offset relative to the second electrical conductor 802, and therefore does not share a common geometric center. This is merely illustrative, and, as noted above, other contemplated (e.g., the first and second electrical conductors 801, 802 share a common geometric center). Moreover, the first electrical conductor 801 illustratively has a substantially rectangular cross-section. This too is not essential and the first electrical conductor 801 may have other cross-sectional shapes, such as circular or elliptical. As can be appreciated from the present teachings, the selection of the shapes of the various components of the transmission lines impacts the orientation of the electric field lines of the substantially TEM mode. The electrically thin resistive layer 803 is selected to have a shape so that the electric field lines of the substantially TEM mode are substantially perpendicular (i.e., substantially parallel to the normal to the electrically thin resistive layer) at each point of incidence, and to be substantially transparent to the substantially TEM mode of transmission, while substantially attenuating higher order modes of transmission.

FIG. 9 is a cross-sectional view a transmission line 900 in accordance with a representative embodiment. Many aspects and details of the transmission line 900 are common to the transmission lines described in connection with the representative embodiments of FIGS. 1-8, above, and may not be repeated in order to avoid obscuring the presently described representative embodiments.

The transmission line 900 is illustratively a microstrip transmission line, comprising a first electrical conductor 901 (i.e., the signal conductor), a second electrical conductor 902 (i.e., the ground conductor) disposed below the first electrical conductor 901. An electrically thin resistive layer 903 is disposed in a substrate 904, which comprises a first dielectric layer 905 and a second dielectric layer 906. A superstrate 907 is disposed over the substrate 904. The first and second dielectric layers 905, 906 have dielectric constants $\in_{r2}$ and $\in_{r3}$, whereas the superstrate 907 has a dielectric constant $\in_{r1}$ less than or equal to that of the substrate 904. By way of example, $\in_{r2}$ is substantially the same as $\in_{r3}$.

The bisecting plane 908 of the first electrical conductor 901 also bisects the electrically thin resistive layer 903. The most intense electric fields occur in the bisecting plane 908, and, as such, hence it is useful that the electrically thin resistive layer 903 be perpendicular to the bisecting plane 908. Also, for most effective attenuation of potentially interfering higher order modes, the electrically thin resistive layer 903 is best situated symmetrically about the bisecting plane 908.

The electrically thin resistive layer 903 is selected to have a shape and orientation so that the electric field lines (not shown) of the desired substantially TEM mode are substantially perpendicular (i.e., parallel to the normal to the electrically thin resistive layer) at each point of incidence, and to be substantially transparent to the substantially TEM mode of transmission, while substantially attenuating higher order modes of transmission.

Figure 10:
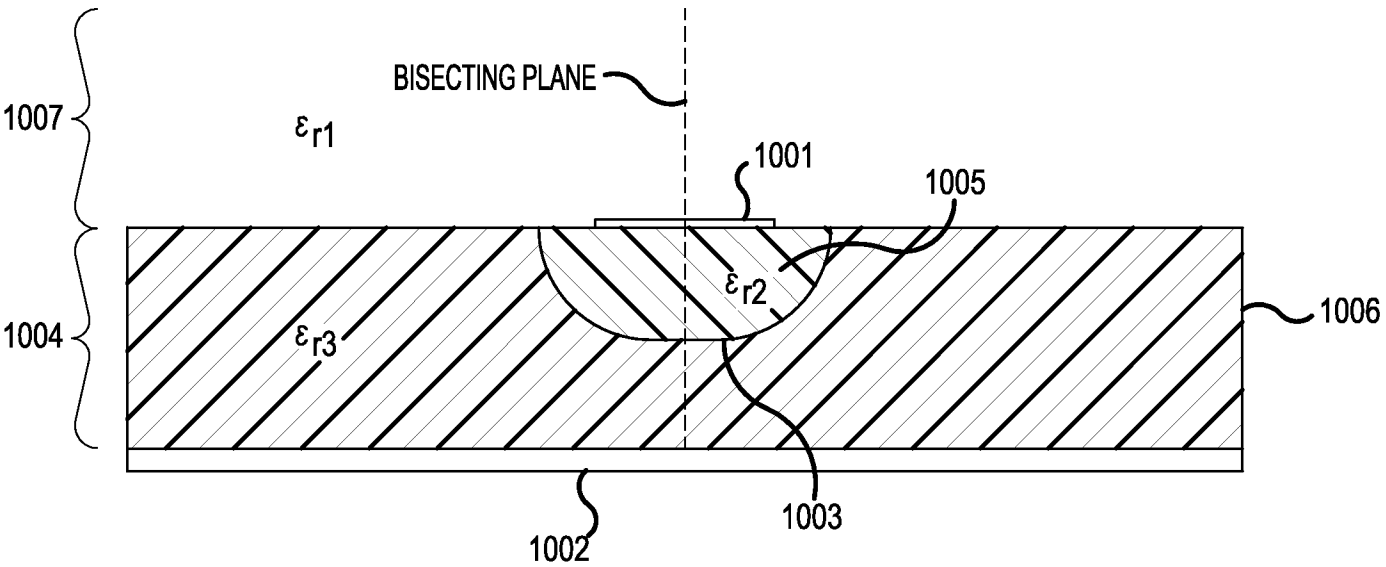
FIG. 10 is a cross-sectional view of a microstrip transmission line in accordance with a representative embodiment.

FIG. 10 is a cross-sectional view a transmission line 1000 in accordance with a representative embodiment. Many aspects and details of the transmission line 1000 are common to the transmission lines described in connection with the representative embodiments of FIGS. 1-9, above, and may not be repeated in order to avoid obscuring the presently described representative embodiments.

The transmission line 1000 is illustratively a microstrip transmission line, comprising a first electrical conductor 1001 (i.e., the signal conductor), a second electrical conductor 1002 (i.e., the ground conductor) disposed below the first electrical conductor 1001. An electrically thin resistive layer 1003 is disposed in a substrate 1004, which comprises a first dielectric layer 1005 and a second dielectric layer 1006. A superstrate 1007 is disposed over the substrate 1004. The first and second dielectric layers 1005, 1006 have dielectric constants $\in_{r2}$ and $\in_{r3}$, whereas the superstrate 1007 has a dielectric constant $\in_{r1}$ less than or equal to that of the substrate 1004. By way of example, $\in_{r2}$is substantially the same as $\in_{r3}$.

The electrically thin resistive layer 1003 is selected to have a shape and orientation so that the electric field lines (not shown) of the substantially TEM mode are substantially perpendicular (i.e., substantially parallel to the normal to the electrically thin resistive layer) at each point of incidence, and to be substantially transparent to the substantially TEM mode of transmission, while substantially attenuating higher order modes of transmission. Notably, and unlike the electrically thin resistive layer 903, electrically thin resistive layer 1003 is curved to follow a magnetic field line contour of the substantially TEM mode all the way to the interface between the substrate 1004 and the superstrate 1007. As will be appreciated by one of ordinary skill in the art, in a substantially TEM mode the electric and magnetic field lines are substantially mutually perpendicular, and their cross product vector (i.e., the Poynting Vector) points in the propagation direction. Hence, if the resistive sheet follows a magnetic field contour, it is automatically everywhere-perpendicular to the electric field.

One benefit of the transmission line 1000 is its greater damping of the higher order modes because of the electrically thin resistive layer 1003 that is oriented relative to the B-field lines of the higher order modes.

Figure 11:
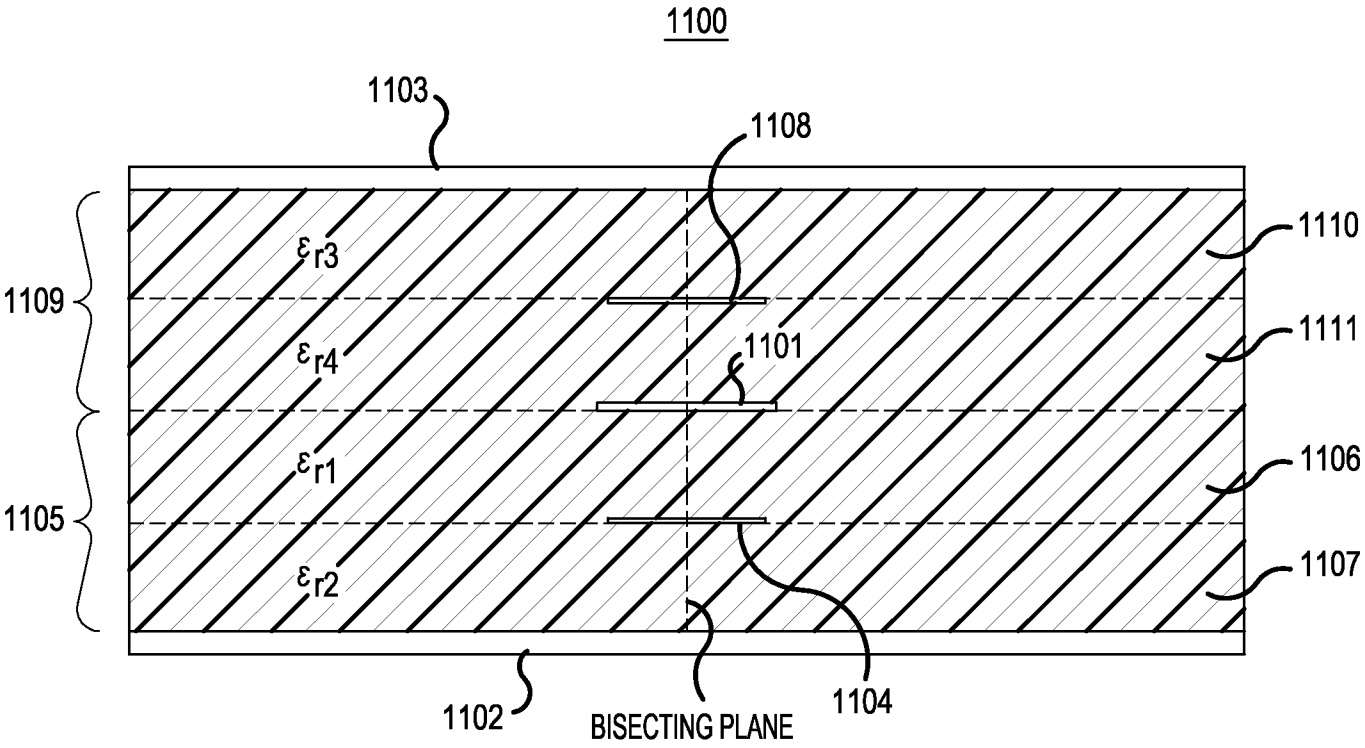
FIG. 11 is a cross-sectional view of a stripline transmission line in accordance with a representative embodiment.

FIG. 11 is a cross-sectional view of a transmission line 1100 in accordance with a representative embodiment. Many aspects and details of the transmission line 1100 are common to the transmission lines described in connection with the representative embodiments of FIGS. 1-10, above, and may not be repeated in order to avoid obscuring the presently described representative embodiments.

The transmission line 1100 is illustratively a stripline transmission line, comprising a first electrical conductor 1101 (i.e., the signal conductor), a second electrical conductor 1102 (i.e., the lower ground conductor) disposed below the first electrical conductor 1101, and a third electrical conductor 1103 (i.e., the upper ground conductor). As is known, ground-to-ground vias (not shown) may be used to ensure the second and third electrical conductors 1102, 1103 are maintained at the same electrical potential.

A first electrically thin resistive layer 1104 is disposed beneath the first electrical conductor 1101 in a substrate 1105, which comprises a first dielectric layer 1106 and a second dielectric layer 1107. A second electrically thin resistive layer 1108 is disposed above the first electrical conductor 1101 in a superstrate 1109, which comprises 1 third dielectric layer 1110 and a fourth dielectric layer 1111. The first~fourth dielectric layers 1106, 1107, 1110, 1111, respectively have dielectric constants $\in_{r1}$, $\in_{r2}$, $\in_{r3}$ and $\in_{r4}$, respectively.

In accordance with a representative embodiment, the dielectric constants of the first~fourth dielectric layers 1106, 1107, 1110, 1111 are substantially the same, hence the lowest order mode of propagation is substantially TEM.

The first and second electrically thin resistive layers 1104, 1108 are selected to have a shape and orientation so that the electric field lines (not shown) of the substantially TEM mode are substantially perpendicular (i.e., substantially parallel to the normal to the electrically thin resistive layer) at each point of incidence, and to be substantially transparent to the substantially TEM mode of transmission, while substantially attenuating higher order modes of transmission.

Figure 12:
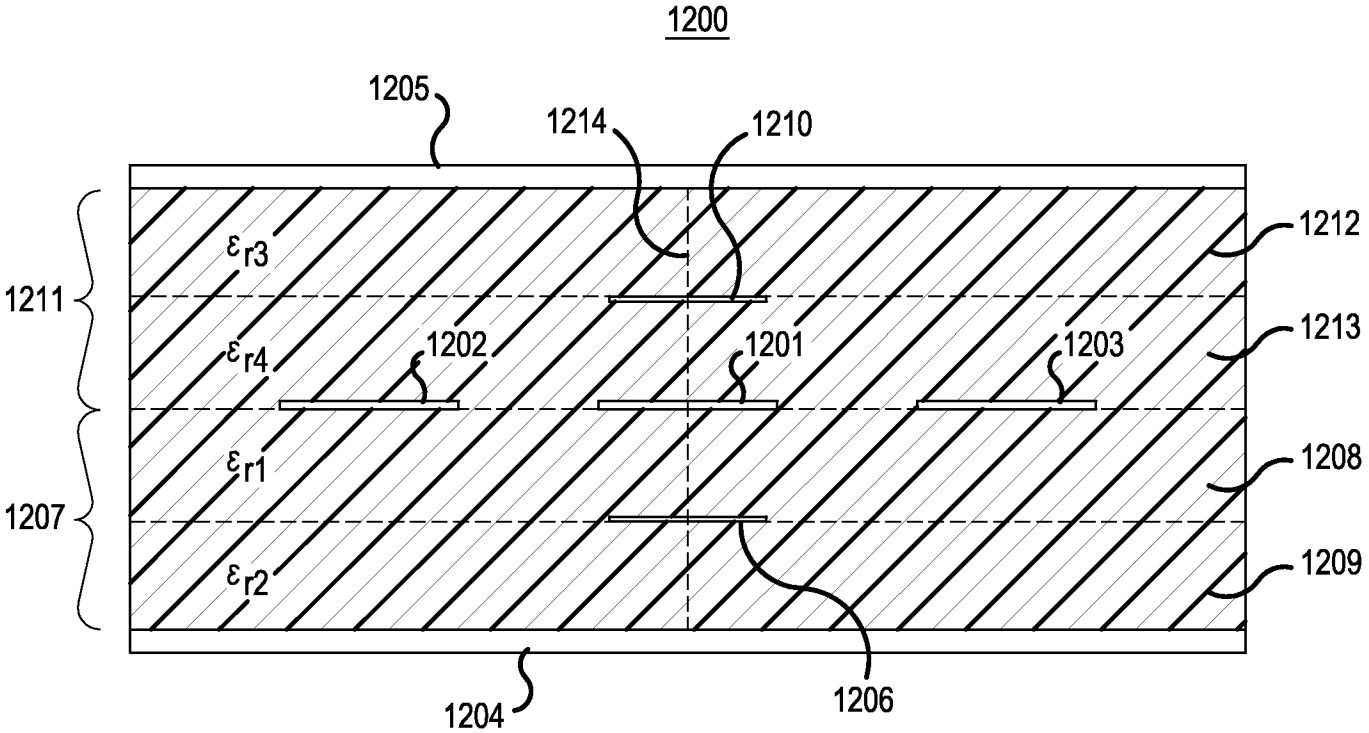
FIG. 12 is a cross-sectional view of a stripline transmission line in accordance with a representative embodiment.

FIG. 12 is a cross-sectional view of a transmission line 1200 in accordance with a representative embodiment. Many aspects and details of the transmission line 1200 are common to the transmission lines described in connection with the representative embodiments of FIGS. 1-11, above, and may not be repeated in order to avoid obscuring the presently described representative embodiments.

The transmission line 1200 is illustratively a stripline transmission line, comprising a first electrical conductor 1201 (i.e., the signal conductor), a second electrical conductor 1202 (i.e., a first coplanar ground conductor) disposed adjacent to the first electrical conductor 1201, and a third electrical conductor 1203 (i.e., a second coplanar ground conductor).

A second electrical conductor 1204 (i.e., the lower ground conductor) is disposed below the first electrical conductor 1201, and a fifth electrical conductor 1205 (i.e., the upper ground conductor) is disposed above the first electrical conductor 1201. As noted above, ground-to-ground vias (not shown) may be used to ensure the second~fifth electrical conductors 1202-1205 are maintained at the same electrical potential.

A first electrically thin resistive layer 1206 is disposed beneath the first electrical conductor 1201 in a substrate 1207, which comprises a first dielectric layer 1208 and a second dielectric layer 1209. A second electrically thin resistive layer 1210 is disposed above the first electrical conductor 1201 in a superstrate 1211, which comprises a third dielectric layer 1212 and a fourth dielectric layer 1213. The first~fourth dielectric layers 1208, 1209, 1212, 1213, respectively, have dielectric constants $\in_{r1}$, $\in_{r2}$, $\in_{r3}$ and $\in_{r2}$, respectively.

In accordance with a representative embodiment, the dielectric constants of the first~fourth dielectric layers 1208, 1209, 1212, 1213 are substantially the same, hence the lowest order mode of propagation is substantially TEM.

The first and second electrically thin resistive layers 1206, 1210 are selected to have a shape and orientation so that the electric field lines (not shown) of the substantially TEM mode are substantially perpendicular (i.e., substantially parallel to the normal to the electrically thin resistive layer) at each point of incidence, and to be substantially transparent to the substantially TEM mode of transmission, while substantially attenuating higher order modes of transmission.

While the invention has been illustrated and described in detail in the drawings and foregoing description, such illustration and description are to be considered illustrative or exemplary and not restrictive; the invention is not limited to the disclosed embodiments.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to an advantage.

While representative embodiments are disclosed herein, one of ordinary skill in the art appreciates that many variations that are in accordance with the present teachings are possible and remain within the scope of the appended claim set. The invention therefore is not to be restricted except within the scope of the appended claims.

The invention claimed is:

1. A coaxial transmission line comprising:

an inner electrical conductor;

an outer electrical conductor;

a dielectric region between the inner electrical conductor and the outer electrical conductor;

an electrically thin resistive layer, within the dielectric region and concentric with the inner electrical conductor and the outer electrical conductor, and configured to be transparent to a substantially transverse-electromagnetic (TEM) mode of transmission while substantially attenuating higher order modes of transmission; and coaxial connectors at opposite ends of the coaxial transmission line; and wherein the electrically thin resistive layer extends within an entire length of coaxial transmission line and within the coaxial connectors.

2. The coaxial transmission line of claim 1, wherein the dielectric region comprises:

an inner dielectric layer between the inner electrical conductor and the electrically thin resistive layer; and an outer dielectric layer between the electrically thin resistive layer and the outer electrical conductor.

3. The coaxial transmission line of claim 2, wherein a thickness of the inner dielectric layer is approximately twice a thickness of the outer dielectric layer.

4. The coaxial transmission line of claim 3, wherein the electrically thin resistive layer comprises a resistive coating disposed over the inner dielectric layer.

5. The coaxial transmission line of claim 1 , wherein the dielectric region comprises:

a first dielectric layer disposed between the inner electrical conductor and the electrically thin resistive layer; and a second dielectric layer between the electrically thin resistive layer and the outer electrical conductor.

6. The coaxial transmission line of claim 5 , wherein the first dielectric layer and the second dielectric layer have approximately a same thickness.

7. The coaxial transmission line of claim 5 , wherein a thickness of the first dielectric layer is approximately twice a thickness of the second dielectric layer.

8. The coaxial transmission line of claim 5, wherein the electrically thin resistive layer comprises an electrically thin resistive coating on the first dielectric layer.

9. The coaxial transmission line of claim 1, wherein the electrically thin resistive layer comprises at least one of TaN, WSiN, resistively-loaded polyimide, graphite, graphene, and transition metal dichalcogenide (TMDC), nichrome, nickel phosphorus, indium oxide, and tin oxide.

10. The coaxial transmission line of claim 1 , wherein the electrically thin resistive layer has an electrical sheet resistance between 20-200 ohms/sq.

11. The coaxial transmission line of claim 1, wherein the inner electrical conductor, outer electrical conductor and dielectric region define a length of micro-coaxial transmission line.

12. The coaxial transmission line of claim 1, further comprising at least one additional resistive layer within the dielectric region and concentric with the inner electrical conductor and the outer electrical conductor.

13. A signal transmission line comprising:

a first electrical conductor;

a second electrical conductor, wherein the first electrical conductor is substantially surrounded by the second electrical conductor, and is offset relative to a geometric center of the second electrical conductor, wherein the first and second electrical conductors are the only electrical conductors of the signal transmission line;

a dielectric region between the first electrical conductor and the second electrical conductor; and an electrically thin resistive layer disposed within the dielectric region and disposed between the first electrical conductor and the second electrical conductor, the electrically thin resistive layer being configured to be substantially transparent to a substantially transverse-electromagnetic (TEM) mode of transmission while substantially attenuating higher order modes of transmission, wherein an electric field exists between the first electrical conductor and the second electrical conductor, the electric field having electric field lines that are perpendicular to the electrically thin resistive layer at each point of contact with the electrically thin resistive layer.

14. The signal transmission line of claim a 13, wherein the dielectric region comprises:

a first dielectric layer disposed between the first electrical conductor and the electrically thin resistive layer; and a second dielectric layer between the electrically thin resistive layer and the second electrical conductor.

15. The signal transmission line of claim 14, wherein the first dielectric layer and the second dielectric layer have approximately a same thickness.

16. The signal transmission line of claim 14, wherein a thickness of the first dielectric layer is approximately twice a thickness of the second dielectric layer.

17. The signal transmission line of claim 14, wherein the electrically thin resistive layer comprises an electrically thin resistive coating on the first dielectric layer.

18. The signal transmission line of claim 14, wherein the electrically thin resistive layer comprises at least one of TaN, WSiN, resistively-loaded polyimide, graphite, graphene, transition metal dichalcogenide (TMDC), nichrome, nickel phosphorus, indium oxide, and tin oxide.

19. The signal transmission line of claim 13, wherein the electrically thin resistive layer is not continuous.

20. The signal transmission line of claim 13, wherein the electrically thin resistive layer has an electrical sheet resistance between 20-2500 ohms/sq.

21. The signal transmission line of claim 13, wherein the electrically thin resistive layer has an electrical sheet resistance between 20-200 ohms/sq.

22. The signal transmission line of claim 13, wherein the first electrical conductor, the second electrical conductor, and the dielectric region define a length of micro-coaxial transmission line.

23. The signal transmission line of claim 13, further comprising at least one additional electrically thin resistive layer disposed within the dielectric region and between the first electrical conductor and the second electrical conductor.

24. A signal transmission line comprising:

an inner electrical conductor;

an outer electrical conductor;

a dielectric region between the inner electrical conductor and the outer electrical conductor, wherein the inner electrical conductor, outer electrical conductor and dielectric region define a length of signal transmission line;

an electrically thin resistive layer disposed within the dielectric region between the inner electrical conductor and the outer electrical conductor, and substantially concentric with the inner and outer electric conductors, the electrically thin resistive layer being configured to be substantially transparent to a substantially transverse-electromagnetic (TEM) mode of transmission while substantially attenuating higher order modes of transmission; and coaxial connectors at opposite ends of the signal transmission line, wherein the electrically thin resistive layer extends within an entire length of the signal transmission line and within the coaxial connectors.

* * * * *